US008136421B2

(12) United States Patent
Kosht et al.

(10) Patent No.: US 8,136,421 B2
(45) Date of Patent: Mar. 20, 2012

(54) GIMBAL ASSEMBLY INCLUDING FLEXIBLE SUBSTRATE WIRING HARNESSES

(75) Inventors: Danial L. Kosht, Gaylord, MI (US); Joseph M. Walling, Boyne City, MI (US); Keith D. Larson, Petoskey, MI (US)

(73) Assignee: Honeywell International Inc., Morristown, NJ (US)

( * ) Notice: Subject to any disclaimer, the term of this patent is extended or adjusted under 35 U.S.C. 154(b) by 1106 days.

(21) Appl. No.: 11/972,281

(22) Filed: Jan. 10, 2008

(65) Prior Publication Data

US 2009/0178499 A1 Jul. 16, 2009

(51) Int. Cl.
*G05G 9/047* (2006.01)

(52) U.S. Cl. ..... 74/471 XY

(58) Field of Classification Search ..... 74/471 XY, 74/523; 244/221, 223, 228, 229, 234; 345/161, 345/168, 156, 157; 341/20, 22
See application file for complete search history.

(56) References Cited

U.S. PATENT DOCUMENTS 4,422,851 A * 12/1983 Hayashigawa et al. ..... 434/45
5,125,602 A 6/1992 Vauvelle
5,142,931 A * 9/1992 Menahem ..... 74/471 XY
5,450,054 A 9/1995 Schmersal
5,687,080 A * 11/1997 Hoyt et al. ..... 700/85
6,000,662 A * 12/1999 Todeschi et al. ..... 244/223
6,002,388 A * 12/1999 Seffernick et al. ..... 345/161
6,104,382 A * 8/2000 Martin et al. ..... 345/161
6,137,475 A * 10/2000 Ginn et al. ..... 345/161
7,648,106 B2 * 1/2010 Granier et al. ..... 244/223

FOREIGN PATENT DOCUMENTS

DE 102006014312 A1 10/2006
EP 1020786 A2 7/2000
GB 2295662 A 6/1996
GB 2313432 A 5/1997

OTHER PUBLICATIONS

EP Search Report dated Dec. 21, 2009, EP 09150356.5-1252/2078999.

* cited by examiner

*Primary Examiner* — Robert Pezzuto
(74) *Attorney, Agent, or Firm* — Ingrassia Fisher & Lorenz, P.C.

(57) ABSTRACT

A gimbal assembly includes a gimbal mechanism, an electrical connector, and a flexible substrate. The gimbal mechanism is configured to rotate about a first rotational axis and a second rotational axis that is perpendicular to the first rotational axis. The electrical connector is coupled to, and mounted on, the gimbal mechanism. The flexible substrate is coupled to the electrical connector and is adapted to be coupled to an external circuit for electrically interconnecting the electrical connector and the external circuit.

17 Claims, 7 Drawing Sheets

GIMBAL ASSEMBLY INCLUDING FLEXIBLE SUBSTRATE WIRING HARNESSES

TECHNICAL FIELD

The present invention generally relates to gimbal assemblies and, more particularly, to wiring harnesses for gimbal assemblies

BACKGROUND

Gimbal assemblies that are used to translate human movements to machine movements are used in myriad industries. For example, some aircraft flight control systems include a gimbal assembly in the form of one or more control sticks (or inceptors). The flight control system, in response to input forces supplied to the control stick from the pilot, controls the movements of various aircraft flight control surfaces. No matter the particular end-use system, the gimbal assembly preferably includes some type of haptic feedback mechanism, either active or passive, back through the interface to the interface operator. The interface also typically includes one or more devices, such as a gimbal mechanism, for accurately converting angular displacements into rotary motion.

Gimbal assemblies that employ gimbal mechanisms also typically rely on various types and amounts of wiring harnesses to interconnect various switches and/or knobs on the control stick to some fixed point in the mechanism. Because the control stick is free to rotate about multiple rotational axes, the wiring also rotates and moves with the control stick. This rotation and movement can cause fatigue stress in some or all of the wiring, which can ultimately lead to electrical opens, if not properly addressed. Moreover, the mass and bending of the wiring needs to be accounted for to properly balance the interface.

Although gimbal assemblies that employ gimbal mechanisms and that address the above-mentioned concerns have been designed and manufactured, addressing these concerns can, in many instances, be the most expensive costs associated with the interface. Hence, there is a need for a gimbal mechanism that includes one or more wiring harnesses that are less susceptible to fatigue stresses as compared to present wiring harnesses and/or that do not adversely impact mechanism balance. The present invention addresses at least these needs.

BRIEF SUMMARY

In one embodiment, and by way of example only, a gimbal assembly includes a gimbal mechanism, an electrical connector, and a flexible substrate. The gimbal mechanism is configured to rotate about a first rotational axis and a second rotational axis that is perpendicular to the first rotational axis. The electrical connector is coupled to, and mounted on, the gimbal mechanism. The flexible substrate is coupled to the electrical connector and is adapted to be coupled to an external circuit for electrically interconnecting the electrical connector and the external circuit.

In another exemplary embodiment, a gimbal assembly includes a gimbal mechanism, an electrical connector, and a flexible substrate. The gimbal mechanism is configured to rotate about a first rotational axis and a second rotational axis that is perpendicular to the first rotational axis. The electrical connector is coupled to, and mounted on, the gimbal mechanism. The flexible substrate is coupled to the electrical connector and is adapted to be coupled to an external circuit for electrically interconnecting the electrical connector and the external circuit. The gimbal mechanism includes a roll hub, a pitch hub, a main hub, a main pitch shaft, a first main roll shaft, and a second main roll shaft. The roll hub is configured to rotate about the first rotational axis. The pitch hub is disposed at least partially within the roll hub and is configured rotate relative to the roll hub about the second rotational axis. The main hub is disposed at least partially within, and is coupled to, the pitch hub. The main pitch shaft is coupled to, and extends through, the main hub along the second rotational axis. The first main roll shaft is coupled to the roll hub and extends therefrom along the first rotational axis. The second main roll shaft is coupled to the roll hub and extends therefrom along the first rotational axis.

Furthermore, other desirable features and characteristics of the gimbal assembly will become apparent from the subsequent detailed description and the appended claims, taken in conjunction with the accompanying drawings.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description. In this regard, although the following description is, for convenience, directed to a gimbal assembly implemented with a user interface that is configured as a control stick, it will be appreciated that the system could be implemented with variously configured user interfaces including, for example, variously configured pedals, yokes, levers, and the like. It will additionally be appreciated that the gimbal assembly may be used in any one of numerous applications, such as gyroscopes, that require two degrees of freedom.

Figure 1:
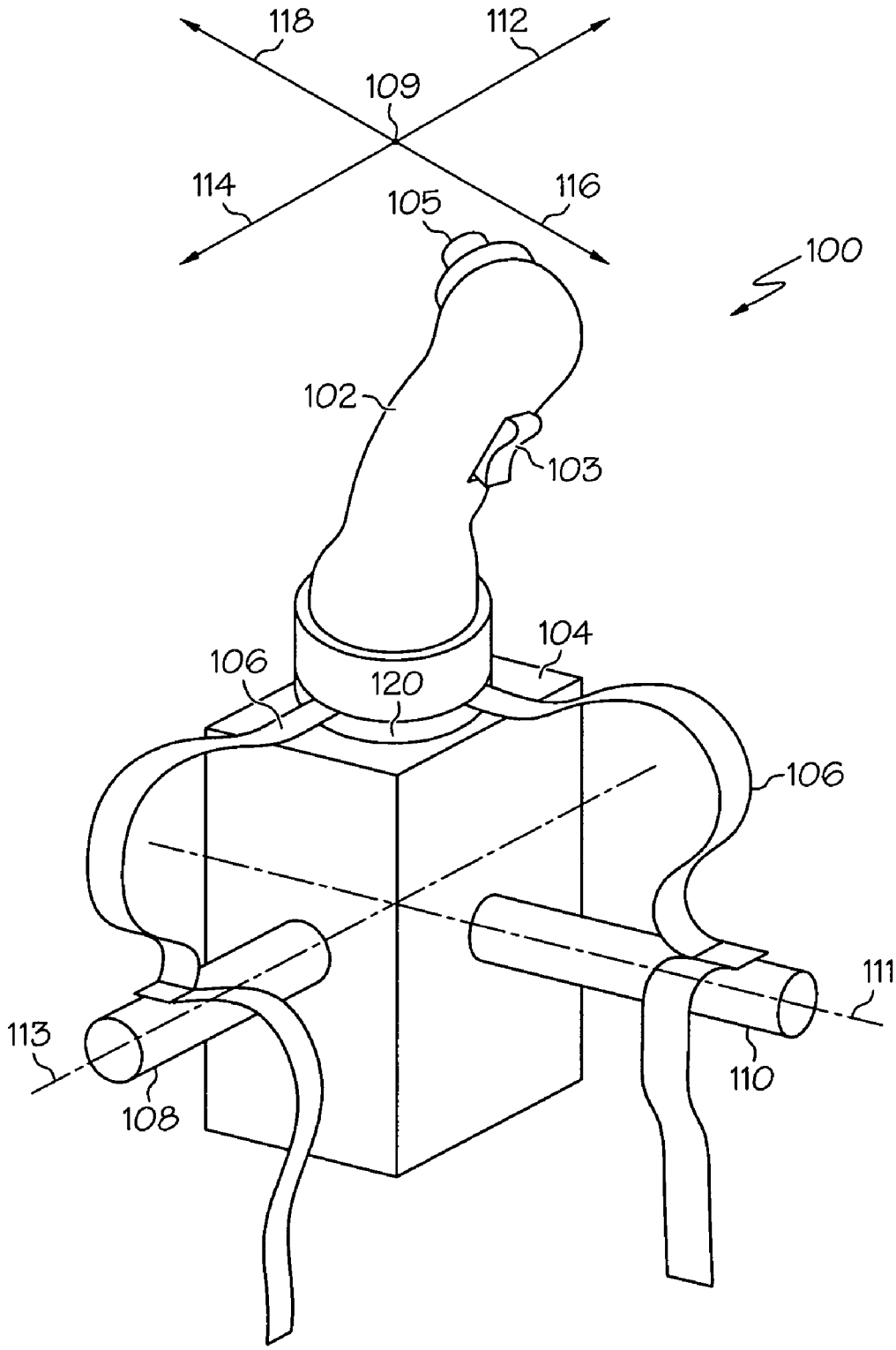
FIG. 1 is a simplified representation of an exemplary embodiment of a portion of a gimbal assembly.

A simplified representation of an exemplary embodiment of a portion of a gimbal assembly 100 is depicted in FIG. 1, and includes a user interface 102, a gimbal mechanism 104, and a flexible substrate 106. The user interface 102 is configured to receive an input force from a user, such as a pilot (or co-pilot), and is preferably implemented as a grip. The user interface 102 is coupled to the gimbal mechanism 104 and may be implemented according to any one of numerous configurations. Moreover, the user interface 102 is preferably dimensioned to be grasped by a hand of a pilot (or co-pilot) or other user. The depicted user interface 102 additionally includes one or more switches 103 and/or knobs 105, and may additionally include one or more non-illustrated sensors (e.g., position sensors, force sensors, etc.). These switches 103, knobs 105, and/or sensors, as will be described in more detail further below, are each electrically coupled to one or more non-illustrated external circuits via the flexible substrate 106.

The gimbal mechanism 104 is preferably mounted within a suitable, non-illustrated housing assembly, and is configured to allow the user interface 102 to be moved from a null position 109, which is the position depicted in FIG. 1, to a plurality of control positions in a plurality of directions. More specifically, the gimbal mechanism 104, in response to an input force supplied to the user interface 102, allows the user interface 102 to be moved from the null position 109 to a plurality of control positions, about two perpendicular rotational axes—a first rotational axis 111 and a second rotational axis 113. In the depicted embodiment, the gimbal mechanism 104 includes at least two shafts to allow such movement about the two rotational axes 111, 113. These include one or more roll shafts 108 and one or more pitch shafts 110. Although only a single roll shaft 108 and a single pitch shaft 110 are depicted in the schematic representation of FIG. 1, it will be appreciated that the gimbal mechanism 104 could be configured to include two roll shafts 108 and/or two pitch shafts 110. Indeed, a configuration of a particular physical implementation of the gimbal mechanism 104, which includes two roll shafts 108, is described in more detail further below.

No matter the number of roll and/or pitch shafts, it is noted that if the gimbal assembly 100 is implemented in an aircraft flight control system, and used as a pilot (or co-pilot) inceptor, then the first and second rotational axes 111, 113 may be referred to as the roll axis and the pitch axis, respectively. Whether or not the gimbal assembly is implemented as such, the gimbal mechanism 104 is configured to allow the user interface 102 to be movable about the first rotational axis 111 in a port direction 112 and a starboard direction 114, and about the second axis 113 in a forward direction 116 and an aft direction 118. It will additionally be appreciated that the gimbal mechanism 104 is configured to allow the user interface 102 to be simultaneously rotated about the first and second rotational axes 111, 113 to move the user interface 102 in a combined forward-port direction, a combined forward-starboard direction, a combined aft-port direction, or a combined aft-starboard direction, and back to or through the null position 109.

Before proceeding further, it is noted that the gimbal assembly 100 may be implemented as either an active system or a passive system. If implemented as an active system, the gimbal assembly 100 may further include one or more non-illustrated motors to actively supply force feedback to the user interface 102. If implemented as a passive system, it will be appreciated that the assembly 100 would not include any motors. In either instance, however, the assembly 100 would preferably include the passive feedback mechanisms 106. In the case of the active system, the motors would be the primary means of supplying feedback force to the user interfaces 102, with the passive force feedback mechanisms 106 being the back-up feedback force source. It will nonetheless be appreciated that in the remainder of the description, the assembly 100 is described as if it were implemented as a fully passive system, without any motors.

As previously noted, the user interface switches 103, knobs 105, and/or sensors are each electrically coupled to one or more non-illustrated external circuits via the flexible substrate 106. To facilitate this electrical interconnection, the gimbal assembly 100 additionally includes an electrical connector 120 that is coupled to, and mounted on, the gimbal mechanism 104. The electrical connector 120 is electrically coupled to the switches 103, knobs 105, and or sensors via suitable, non-illustrated wiring or various other interconnections.

Figure 2:
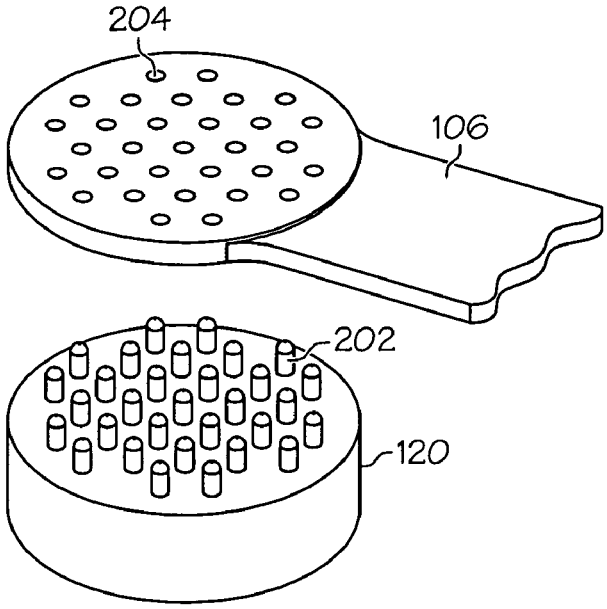
FIG. 2 is a perspective view of an electrical connector and a portion of an exemplary flexible substrate that may be used to implement the gimbal assembly of FIG. 1.

The flexible substrate 106 is coupled to the electrical connector 120 and is adapted to be coupled to the one or more non-illustrated external circuits that were previously mentioned. In this manner the flexible substrate 106 electrically interconnects the electrical connector 120, and thus the user interface switches 103, knobs 105, and/or sensors, to these one or more external circuits. The flexible substrate 106 may be coupled to the electrical connector 120 using any one of numerous techniques. For example, the flexible substrate 106 may be soldered to the electrical connector 120, inserted into the electrical connector 120, or formed as an integral part of the electrical connector 120, just to name a few. A particular preferred technique that is used to couple to flexible substrate 106 and the electrical connector is depicted in FIG. 2, and with reference thereto will now be briefly described.

In accordance with the preferred technique, the electrical connector 120 includes a plurality of pins 202 and the flexible substrate 106 includes a plurality of openings 204. The pins 202 are disposed in a particular pattern and are electrically coupled to the switches 103, knobs 105, and/or sensors via suitable conductors. These conductors may include, for example, wires, receptacles configured to receive the pins 202 therein, or combinations of each. In any case, it is seen that the flexible substrate openings 204 are disposed in a pattern that matches the pattern in which the pins 202 are disposed.

Figure 3:
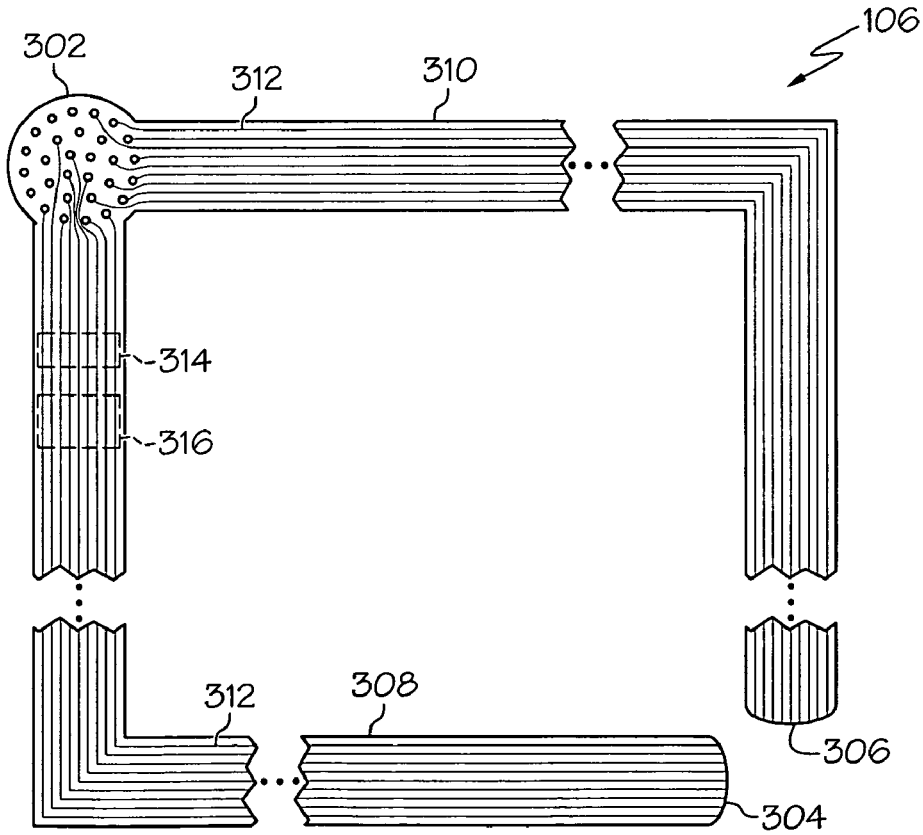
FIG. 3 depicts an exemplary flexible substrate that may be used to implement the gimbal assembly of FIG. 1.
Figure 4:
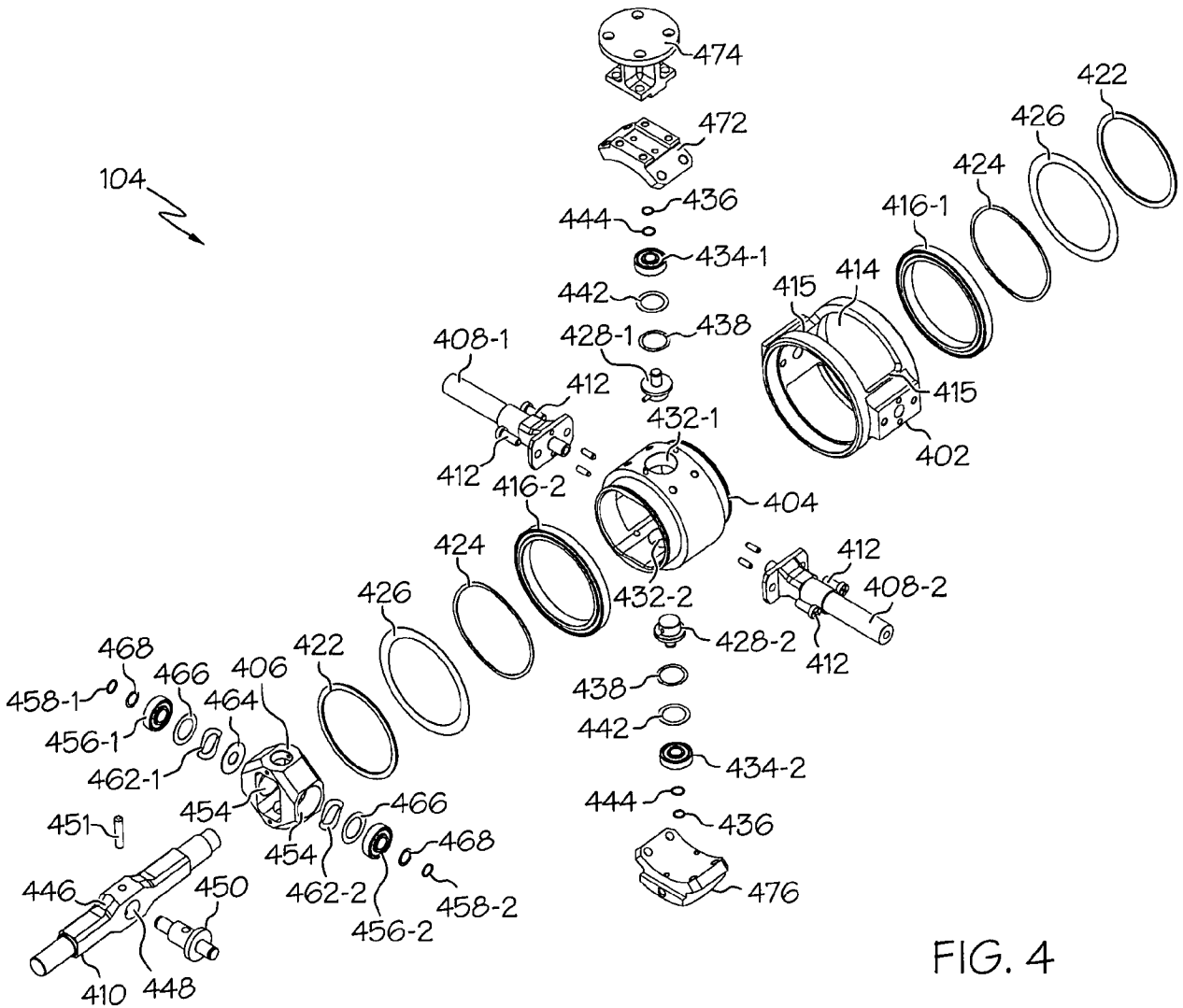
FIG. 4 is an exploded isometric view of an exemplary physical implementation of a gimbal mechanism that may be used to implement the gimbal assembly of FIG. 1.
Figure 5:
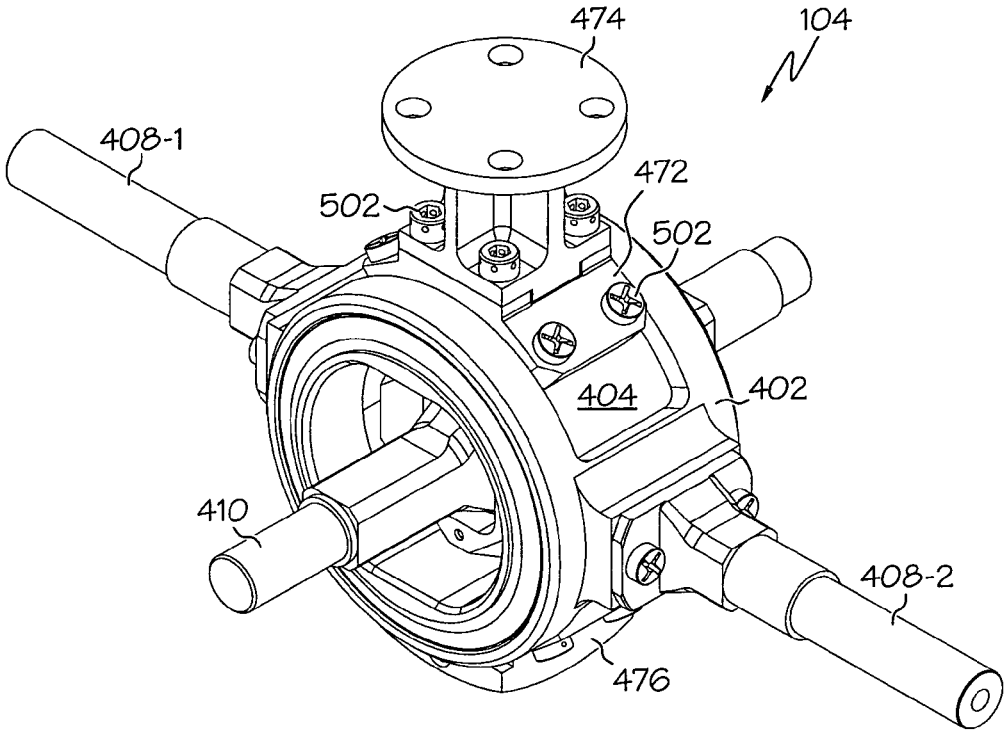
FIG. 5 is an isometric views of the gimbal mechanism of FIG. 4.
Figure 6:
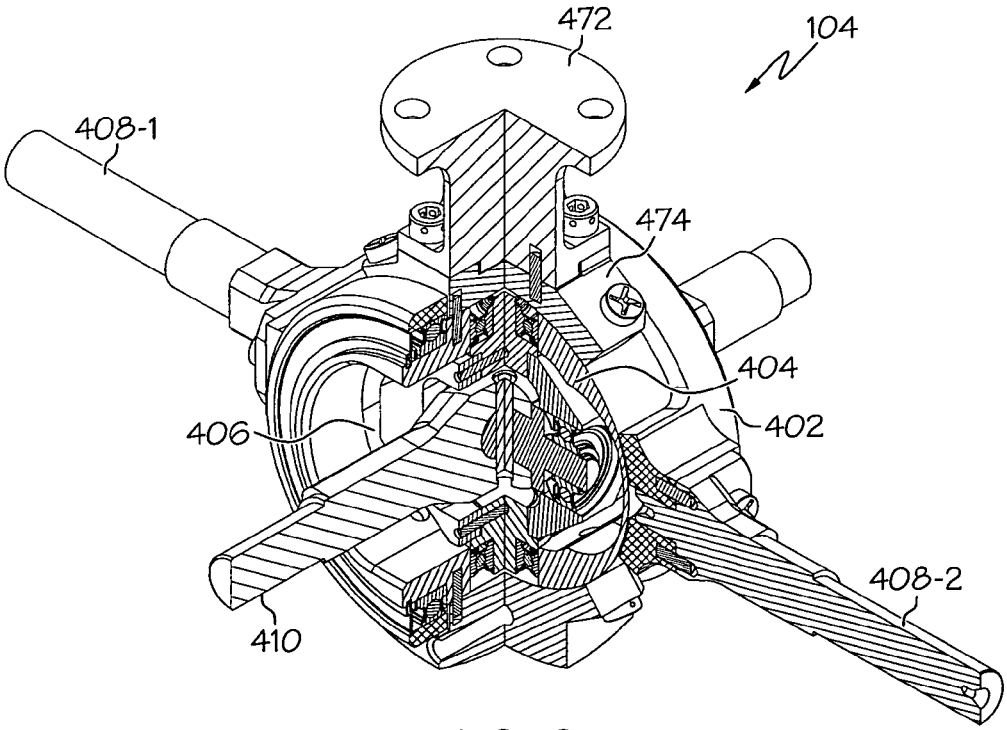
FIG. 6 is a partial cross section view of the exemplary gimbal mechanism depicted in FIG. 5.
Figure 7:
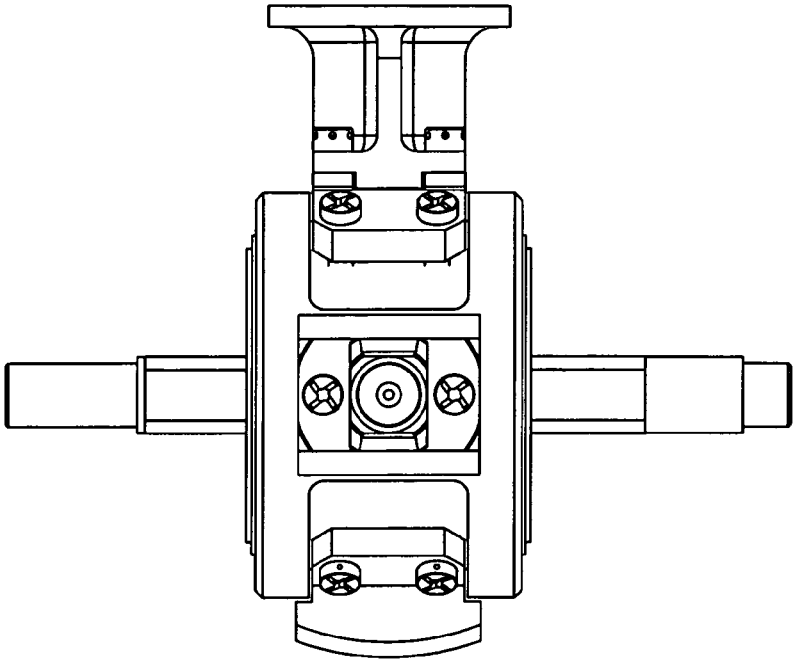
FIGS. 7 and 8 are end and side views, respectively, of the gimbal mechanism depicted in FIGS. 4-6.
Figure 9:
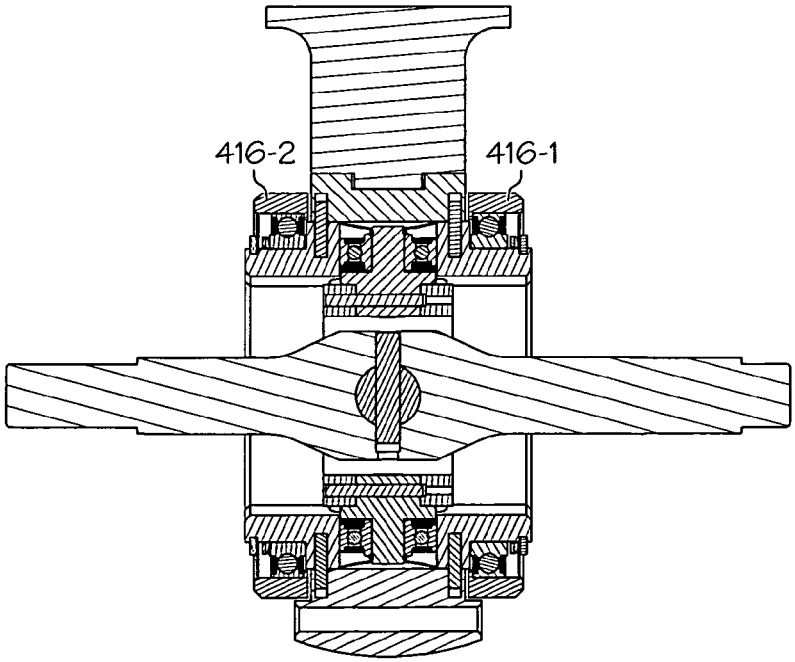
FIG. 9 is a cross section view of the gimbal mechanism taken along line 9-9 of FIG. 8.
Figure 8:
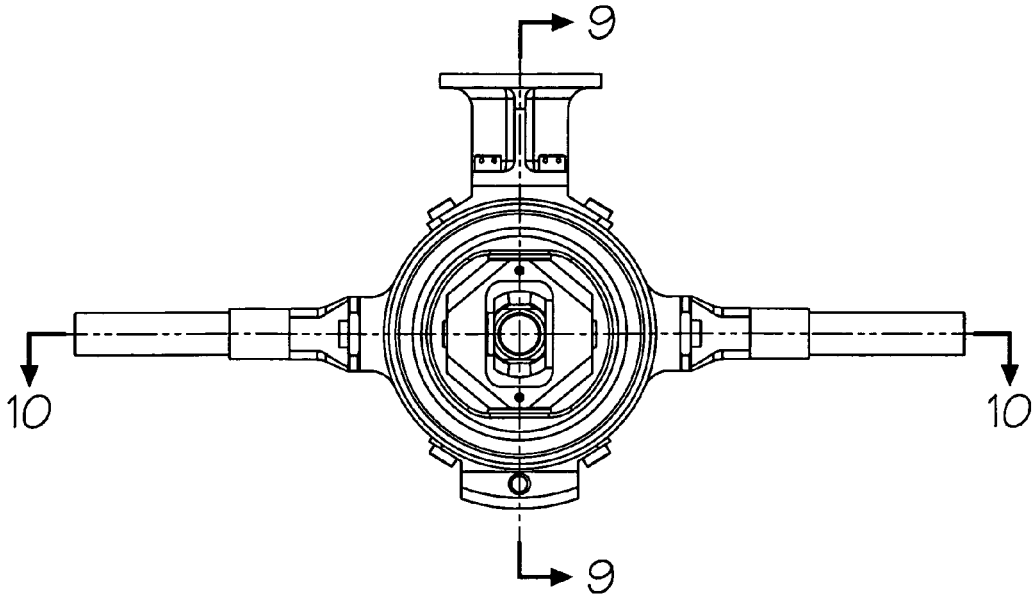
Figure 10:
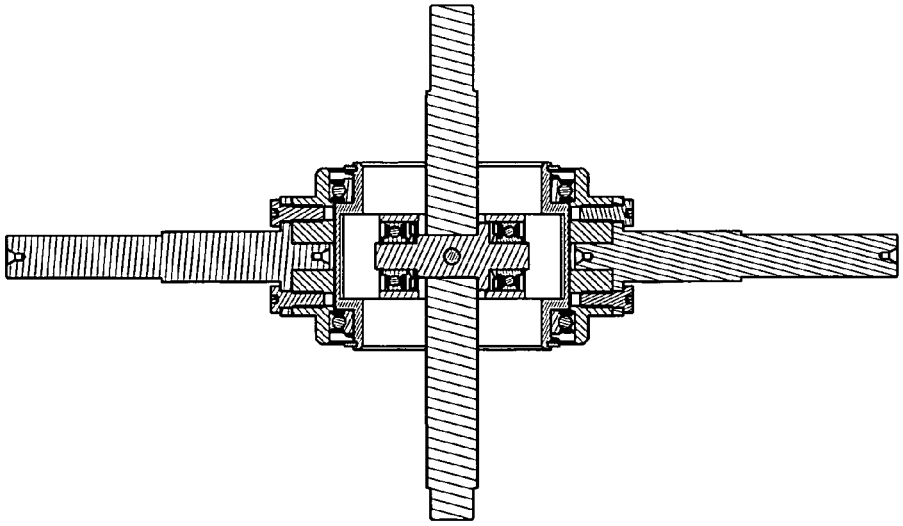
FIG. 10 is a cross section view of the gimbal mechanism taken along line 10-10 of FIG. 8.

The flexible substrate 106 may be variously configured, but in the depicted embodiment, and with reference to FIG. 3, it is seen that it includes a first interconnect end 302, a second interconnect end 304, a third interconnect end 306, a first arm 308, and a second arm 310. The first interconnect end 302 is coupled to the electrical connector 120 as described above. The second interconnect end 304 and the third interconnect end 306 are each adapted to be coupled to the one or more external circuits. The first arm 308 extends between the first and second interconnect ends 304, 306, and is coupled to either the roll shaft 108 or the pitch shaft 110 intermediate the first and second interconnect ends 304, 306. The second arm 310 extends between the first and third interconnect ends 304, 308, and is coupled to either the roll shaft 108 or the pitch shaft 110 intermediate the first and third interconnect ends 304, 308.

It is noted that the flexible substrate 106, as just described, is preferably implemented with multiple arms. By doing so, the overall spring forces associated with the flexing of the flexible substrate 106 during gimbal mechanism operation can be essentially canceled. As a result, the gimbal mechanism 104, and thus the user interface 102, will readily and repeatedly return to its zero-force, null position 109. Moreover, as FIG. 3 further depicts, the first and second arms 308, 310 each preferably makes a 90-degree bend between the first interconnect end 302 and the second and third interconnect ends 304, 306, respectively.

It is further noted that although the flexible substrate 106 depicted in FIG. 3 and described above is implemented as a single structure having one first interconnect end 302 that couples to the electrical connector 120, and two arms 308, 310 that extend from the one first interconnect end 302, it could be variously implemented. For example, the flexible substrate 106 could be implemented using two individual substrates, with each individual substrate constituting one of the arms 308, 310. In such an implementation, each arm 308, 310 would have a first interconnect end 302, and each of the first interconnect ends 302 would be coupled to the electrical connector 120. Still, in this alternative implementation, one of the arms 308 or 310 would be coupled to the roll shaft 108 and the other arm 310 or 308 would be coupled to the pitch shaft 110. Nonetheless, in each embodiment the flexible substrate 106 further includes a plurality of electrically conductive signal traces 312. Each signal trace 312 electrically communicates one of the plurality of openings 204, and thus one of the plurality of pins 202, to either the second or the third interconnect end 308, 310.

In some embodiments, the flexible substrate 106 may include one or more additional elements to thereby implement one or more additional functions. For example, as FIG. 3 depicts in phantom, the flexible substrate 106 may integrate one or more sensing elements 314. The sensing elements 314, if included, are preferably fabricated directly onto flexible substrate 106 and may be implemented using, for example, piezo film elements, thin resistor elements, or both. The integrated sensing elements 314 may be used to measure various parameters. For example, the piezo films could be used to measure dynamic strain, acceleration, and vibration, and the film resistor elements could be used to measure static strain and temperature. It will additionally be appreciated that in some embodiments, user interface position could be interpolated from the output of the film resistor elements.

As FIG. 3 also depicts in phantom, the flexible substrate 106 may, in some embodiments, include integrated electronics 316. The electronics 316, if included, is preferably fabricated directly onto the flexible substrate 106 and may implement any one or more of numerous functions. Some non-limiting examples of the functions that the integrated electronics 316 may implement include one or more of current sensing, signal conditioning, TTL level shifting, noise filtering, and analog to digital conversion. It will be appreciated that in some embodiments, the flexible substrate 106 may include both the integrated sensing elements 314 and the integrated electronics 316. It will additionally be appreciated that although the integrated sensing elements 314 and the integrated electronics 316 are, for ease of illustration, depicted as being collocated and disposed on one of the arms 308, 310 (e.g., the first arm 308 in the depicted embodiment), these elements need not be collocated and may be disposed at any one of numerous locations on the flexible substrate 106.

It was noted above that a description of a particular physical implementation of the gimbal mechanism 104 that includes two roll shafts 108 could be provided. With reference now to FIGS. 4-10, the description of this particular implementation will, for completeness, now be provided. The depicted gimbal mechanism 104 includes a roll hub 402, a pitch hub 404, a main hub 406, a first main roll shaft 108-1, a second main roll shaft 108-2, and a main pitch shaft 110. The roll hub 402 is configured to rotate about the first rotational axis 111 via the first and second main roll shafts 108-1, 108-2. More specifically, the main roll shafts 108 are each configured to be rotationally mounted to a non-illustrated housing assembly via, for example, a set of suitable bearings. The main roll shafts 108 are each coupled to the roll hub 402 via suitable fasteners 414. It will be appreciated, however, that the main roll shafts 108 could be coupled to the roll hub 402 using any one of numerous alternative techniques. For example, the main roll shafts could be welded to the roll hub 402 or formed with the roll hub 402 in a one-piece construction. The roll hub 402 additionally includes a user interface opening 414. The user interface opening 414 allows the user interface 102 to be coupled to the pitch hub 404, in a manner described further below, and additionally defines a plurality of integral pitch stop surfaces 415. The integral pitch stop surfaces 415 limit rotation of the pitch hub 404 and, concomitantly, the user interface 102, about the second rotational axis 113.

The pitch hub 404 is disposed, at least partially, within the roll hub 402 and is configured to rotate relative to the roll hub 402 about the second rotational axis 113. To implement this relative rotation, the gimbal mechanism 104 further includes a plurality of pitch hub bearings 416 (e.g., 416-1, 416-4). The pitch hub bearings 416 are each disposed between the roll hub 402 and the pitch hub 404, and include an inner race, an outer race, and a plurality of bearing balls disposed between the inner and outer races. The pitch hub bearing inner races are mounted on the pitch hub 404, and the pitch hub bearing outer races engage the roll hub 402.

The pitch hub bearings 416 are each retained in position, preferably in a free floating manner, via a pitch hub bearing retaining ring 422 and a pitch hub bearing spring 424. More specifically, each pitch hub bearing retaining ring 422 is disposed within a non-illustrated groove formed in the pitch hub 404. The pitch hub bearing springs 424, which in the depicted embodiment are implemented using spring washers, are each disposed between one of the pitch hub bearing retaining rings 422 and one of the pitch hub bearings 416. In the depicted embodiment, only a single pitch hub bearing spring 424 is disposed between each pitch hub bearing 416 and pitch hub bearing retaining ring 422. It will be appreciated, however, that more than one pitch hub bearing spring 424 could be used, if needed or desired. No matter the number of pitch hub bearing springs 424 that are used, each supplies a bias force to one of the pitch hub bearings 416 that pre-loads the pitch hub bearings 416 axially inwardly toward the pitch hub 404, in a free-floating manner. As FIG. 4 further depicts, one or more suitably sized shims 426 may be disposed between each pitch hub bearing retaining ring 422 and pitch hub bearing spring 424, as needed or desired.

The main hub 406 is disposed, at least partially, within the pitch hub 404, and is additionally coupled to the pitch hub 404. In the depicted embodiment, the main hub 406 is coupled to the pitch hub 404 via a plurality of shafts 428; namely, a first minor pitch shaft 428-1 and a second minor pitch shaft 428-2. The first and second minor pitch shafts 428-1, 428-2 are each coupled to the main hub 406 via, for example, suitable non-illustrated pins. The first and second minor pitch shafts 428-1, 428-2 each extend, in opposite directions along a third rotational axis that is perpendicular to the first and second rotational axes 111, 113, from the main hub 406 into first and second bearing cavities 432-1, 432-2, respectively, formed in the pitch hub 404. A first minor pitch shaft bearing 434-1 is disposed in the first bearing cavity 432-1, and a second minor pitch shaft bearing 434-2 is disposed in the second bearing cavity 432-2. The first minor pitch shaft bearing 434-1 is mounted on the first minor pitch shaft 428-1, and is disposed between the first minor pitch shaft 428-1 and the pitch hub 404. Similarly, the second minor pitch shaft bearing 434-2 is mounted on the second minor pitch shaft 428-2, and is disposed between the second minor pitch shaft 428-2 and the pitch hub 404. The minor pitch shaft bearings 434 each include an inner race, an outer race, and a plurality of bearing balls disposed between the inner and outer races. The minor pitch shaft bearing inner races are each mounted on one of the minor pitch shafts 428-1, 428-4, and the minor pitch shaft bearing outer races each engage an inner surface of one of the roll hub bearing cavities 432-1, 432-4. As a result, the first and second minor pitch shafts 428-1, 428-2 may rotate relative to the pitch hub 404 about the third rotational axis.

The minor pitch shaft bearings 434, similar to the pitch hub bearings 416, are each retained in position, in a free floating manner, via a minor roll shaft bearing retaining ring 436 and a minor roll shaft bearing spring 438. More specifically, each minor pitch shaft bearing retaining ring 436 is disposed within a groove formed in each of the minor pitch shafts 428. The minor roll shaft bearing springs 438, which in the depicted embodiment are also implemented using spring washers, are each disposed between a non-illustrated annular spring retaining surface formed on each minor pitch shaft 428 and one of the minor pitch shaft bearings 434. In the depicted embodiment, only a single minor pitch shaft bearing spring 438 is disposed between each annular spring retaining surface and minor pitch shaft bearing retaining ring 436. It will be appreciated, however, that more than one minor pitch shaft bearing spring 438 could be used, if needed or desired. No matter the number of minor pitch shaft bearing springs 438 that are used, each preferably supplies a bias force to one of the minor pitch shaft bearings 434 that pre-loads the minor pitch shaft bearings 434 outwardly away from the annular spring retaining surface, preferably in a free-floating manner. As FIG. 4 further depicts, one or more suitably sized shims 442, 444 may be disposed between each minor pitch shaft bearing spring 438 and each minor pitch shaft bearing 434 and/or each minor pitch shaft retaining ring 436, as needed or desired.

The main pitch shaft 410 extends through the main hub 406, and thus through the pitch hub 404 and the roll hub 402, along the second rotational axis 113. The main pitch shaft 410 includes a plurality of integral roll stop surfaces 446 and a minor roll shaft opening 448. The main pitch shaft 410 may be rotationally mounted to via a set of non-illustrated main pitch shaft bearing assemblies. As such, the main pitch shaft 410 is rotatable about the second rotational axis 113. The integral roll stop surfaces 446 are formed on the main pitch shaft 410 and limit rotation of the main hub 406 and, concomitantly, the user interface 102, about the first rotational axis 111. The minor roll shaft opening 448 extends through the main pitch shaft 410 and is configured to receive a minor roll shaft 450.

The minor roll shaft 450 extends into and through the minor roll shaft opening 448 along the first rotational axis 111. It may thus be appreciated that the minor roll shaft 450 is disposed perpendicular to the main pitch shaft 410. The minor roll shaft 450 is coupled to the main pitch shaft 410 via, for example, a dowel pin 451, and the ends of the minor roll shaft 450 extend into minor roll shaft bearing cavities 454 formed in the main hub 406. A minor roll shaft bearing 456 (e.g., 456-1, 456-2) is disposed in each minor roll shaft bearing cavity 454. The minor roll shaft bearings 456 are mounted on the minor roll shaft 450, and are disposed between the minor roll shaft 450 and the main hub 406. The minor roll shaft bearings 456, like each of the previously-described bearings, preferably include an inner race, an outer race, and a plurality of bearing balls disposed between the inner and outer races. The minor roll shaft bearing inner races are each mounted on the minor roll shaft 450, and the minor roll shaft bearing outer races each engage an inner surface of one of the minor roll shaft bearing cavities 454. As a result, relative rotation about the third rotational axis may occur between the minor roll shaft 450 and the main hub 406.

The minor roll shaft bearings 456 are retained in position, in a free floating manner, similar to how each of the minor pitch shaft bearings 434 are retained in position. In particular, a non-illustrated first groove and a non-illustrated second groove are formed in the minor roll shaft 450 adjacent a first end and a second end, respectively, thereof. A first retaining ring 458-1 is disposed within the first groove, and a second retaining ring 458-2 is disposed in the second groove. A minor roll shaft bearing spring 462, which in the depicted embodiment is also implemented using a spring washer, is disposed within each main hub bearing cavity 454 between the main pitch shaft 410 and each of the minor roll shaft bearings 456. More specifically, because of the manner in which the minor roll shaft 450 is configured in the depicted embodiment, one of the minor roll shaft bearing springs 462-2 is disposed between a minor roll shaft bearing 456-2 and a non-illustrated annular retaining surface formed on the minor roll shaft 450, and the other minor roll shaft bearing spring 462-1 is disposed between the other minor roll shaft bearing 456-1 and a spring retaining shim 464 that is disposed over the minor roll shaft 450. Although a single minor roll shaft bearing spring 462 is disposed within each main hub bearing cavity 454, it will be appreciated that more than one minor roll shaft bearing spring 462 could be used, if needed or desired. Moreover, no matter the number of minor roll shaft bearing springs 462 that are used, each supplies a bias force to one of the minor roll shaft bearings 456 that pre-loads the minor roll shaft bearings 456 outwardly away from the main pitch shaft 410, preferably in a free-floating manner. One or more suitably sized shims 466, 468 may be disposed between each minor roll shaft bearing 456 and each minor roll shaft bearing spring 462 and/or each minor roll shaft retaining ring 458, as needed or desired.

In addition to each of the above-described components the gimbal mechanism 104, at least in the depicted embodiment, additionally includes a control base 472, a user interface mounting post 474, and a rigging bracket 476. The control base 472 is coupled to the pitch hub 404 and is disposed over the pitch hub first bearing cavity 434-1. The control base 472 is additionally coupled to the user interface mounting post 474. In the depicted embodiment, as shown most clearly in FIGS. 8 and 9, a plurality of suitable fasteners 502 are used to couple the control base 472 to the pitch hub 404 and to couple the user interface mounting post 474 to the control base 472. The user interface 104, which is not depicted in any of FIGS. 4-10, is in turn coupled to the user interface mounting post 474 via, for example, a plurality of suitable, non-illustrated fasteners. The rigging bracket 476 is coupled to the pitch hub 404 generally opposite the control base 474, and is disposed over the pitch hub second bearing cavity 434-4. In the depicted embodiment the rigging bracket 476 is coupled to the pitch hub 404 via suitable, non-illustrated fasteners.

Figure 11:
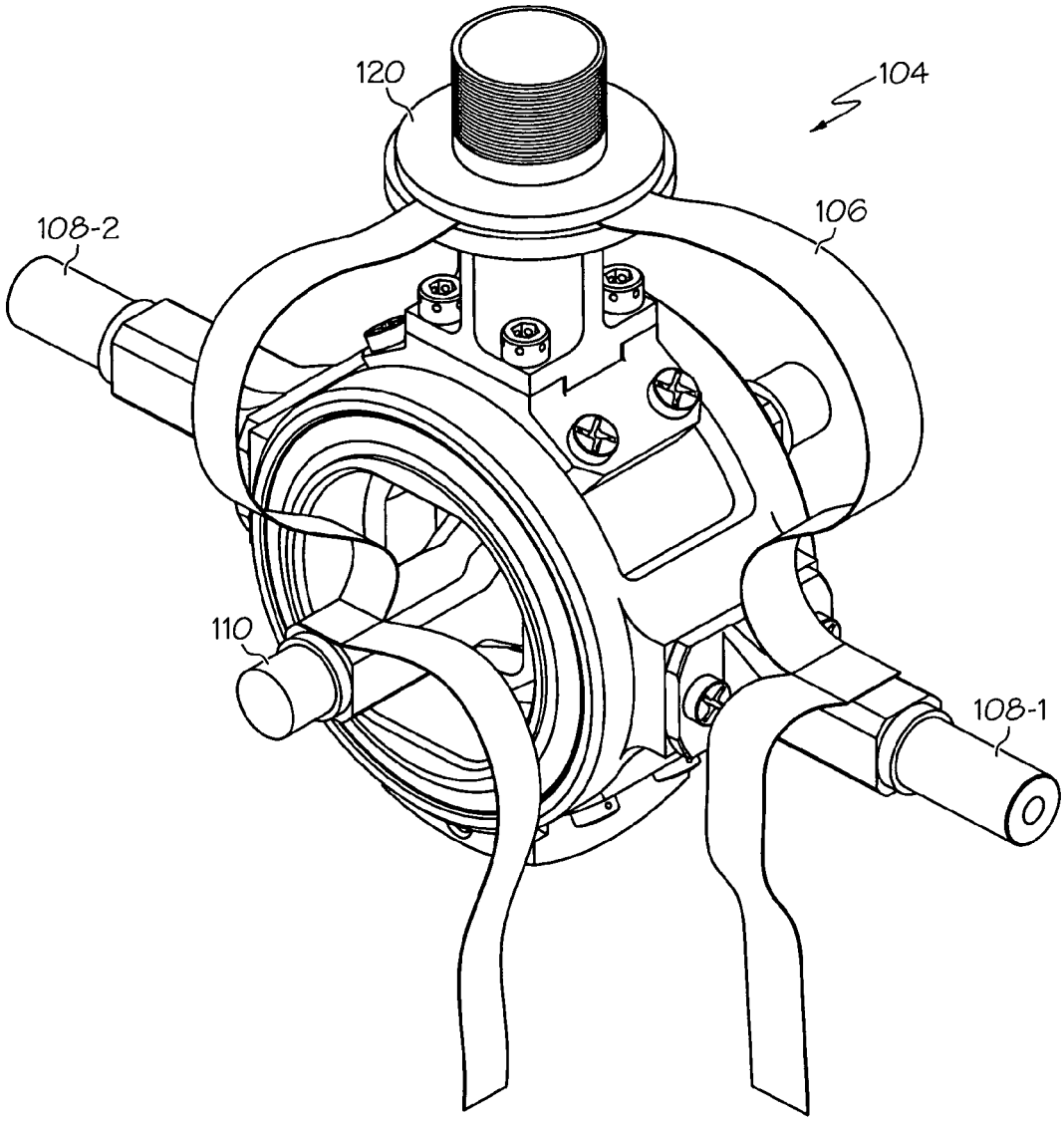
FIG. 11 depicts the gimbal mechanism of FIGS. 4-10 in its fully assembled form with a flexible substrate coupled thereto.

The gimbal mechanism 104 described above and depicted in FIGS. 4-10, is depicted in its fully assembled form in FIG. 11 with the flexible substrate 106 coupled thereto. In this, as with the generic embodiment depicted in FIG. 1 and previously described, the flexible substrate 106 makes a 90-degree bend, where it is coupled to the roll and pitch shafts 108, 110. The flexible substrate 106 is also disposed and configured such that the overall spring forces associated with the flexing of the flexible substrate 106 during gimbal mechanism operation can be essentially canceled so that the gimbal mechanism 104, and thus the user interface 102, will readily and repeatedly return to its zero-force, null position 109.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A gimbal assembly, comprising:

a gimbal mechanism configured to rotate about a first rotational axis and a second rotational axis that is perpendicular to the first rotational axis, the gimbal mechanism comprising a roll shaft and a pitch shaft, the roll shaft extending along the first rotational axis, the pitch shaft extending along the second rotational axis;

an electrical connector coupled to, and mounted on, the gimbal mechanism; and a flexible substrate coupled to the electrical connector, the roll shaft, and the pitch shaft, and adapted to be coupled to an external circuit for electrically interconnecting the electrical connector and the external circuit, wherein the flexible substrate comprises:

a first interconnect end, a second interconnect end, and a third interconnect end, the first interconnect end coupled to the electrical connector, the second and third interconnect ends each adapted to be coupled to the external circuit;

a first arm extending between the first and second interconnect ends, the first arm coupled to the pitch shaft intermediate the first and second interconnect ends; and a second arm extending between the first and third interconnect ends, the second arm coupled to the roll shaft intermediate the first and third interconnect ends.

2. The gimbal assembly of claim 1, wherein the flexible substrate comprises one or more piezo film sensors integrally formed thereon.

3. The gimbal assembly of claim 1, wherein the flexible substrate comprises one or more film resistors integrally formed thereon.

4. The gimbal assembly of claim 1, wherein:

the first arm makes a 90-degree bend between the first interconnect end and the second interconnect end; and the second arm makes a 90-degree bend between the first interconnect end and the third interconnect end.

5. The gimbal assembly of claim 1, wherein:

the electrical connector comprises a plurality of pins disposed in a pattern;

the first interconnect end comprises a plurality of openings disposed in the pattern of the plurality of pins; and each of the plurality of pins extends through one of the plurality of openings.

6. The gimbal assembly of claim 5, wherein:

the flexible substrate comprises a plurality of electrically conductive signal traces, each signal trace electrically communicating one of the plurality of pins to either the second or the third interconnect end.

7. The gimbal assembly of claim 1, wherein:

the gimbal mechanism comprises a user interface mount adapted to be coupled to a user interface; and the electrical connector is coupled to the user interface mount.

8. The gimbal assembly of claim 7, further comprising a user interface coupled to the user interface mount.

9. The gimbal assembly of claim 1, wherein the flexible substrate comprises functional electronics integrally formed thereon.

10. A gimbal assembly, comprising:

a gimbal mechanism configured to rotate about a first rotational axis and a second rotational axis that is perpendicular to the first rotational axis;

an electrical connector coupled to, and mounted on, the gimbal mechanism; and a flexible substrate coupled to the electrical connector and adapted to be coupled to an external circuit for electrically interconnecting the electrical connector and the external circuit, wherein the gimbal mechanism comprises:

a roll hub configured to rotate about the first rotational axis;

a pitch hub disposed at least partially within the roll hub and configured rotate relative to the roll hub about the second rotational axis;

a main hub disposed at least partially within, and coupled to, the pitch hub; and a main pitch shaft coupled to, and extending through, the main hub along the second rotational axis;

a first main roll shaft coupled to the roll hub and extending therefrom along the first rotational axis; and a second main roll shaft coupled to the roll hub and extending therefrom along the first rotational axis.

11. The gimbal assembly of claim 10, wherein the flexible substrate is further coupled to one of the main roll shafts.

12. The gimbal assembly of claim 11, wherein the flexible substrate comprises:

a first interconnect end, a second interconnect end, and a third interconnect end, the first interconnect end coupled to the electrical connector, the second and third interconnect ends adapted to be coupled to the external circuit;

a first arm extending between the first and second interconnect ends, the first arm coupled to the main pitch shaft intermediate the first and second interconnect ends; and a second arm extending between the first and third interconnect ends, the second arm coupled to one of the main roll shafts intermediate the first and third interconnect ends.

13. The gimbal assembly of claim 12, wherein:

the electrical connector comprises a plurality of pins disposed in a pattern;

the first interconnect end comprises a plurality of openings disposed in the pattern of the plurality of pins; and each of the plurality of pins extends through one of the plurality of openings.

14. The gimbal assembly of claim 13, wherein:

the flexible substrate comprises a plurality of electrically conductive signal traces, each signal trace electrically communicating one of the plurality of pins to either the second or the third interconnect end.

15. The gimbal assembly of claim 10, wherein:

the gimbal mechanism comprises a user interface mount adapted to be coupled to a user interface; and the electrical connector is coupled to the user interface mount.

16. The gimbal assembly of claim 15, further comprising a user interface coupled to the user interface mount.

17. The gimbal assembly of claim 12, wherein:

the first arm makes a 90-degree bend between the first interconnect end and the main pitch shaft; and the second arm makes a 90-degree bend between the first interconnect end and the main roll shaft to which the second arm is coupled.

* * * * *